United States Patent [19]

Pan et al.

[11] Patent Number: 4,931,813

[45] Date of Patent: Jun. 5, 1990

[54] INK JET HEAD INCORPORATING A THICK UNPASSIVATED TAAL RESISTOR

[75] Inventors: Alfred I. Pan, Mountain View; Howard H. Taub, San Jose; Harold W. Levie, Livermore, all of Calif.

[73] Assignee: Hewlett-Packard Company, Palo Alto, Calif.

[21] Appl. No.: 317,106

[22] Filed: Feb. 28, 1989

Related U.S. Application Data

[63] Continuation of Ser. No. 99,428, Sep. 21, 1987, abandoned.

[51] Int. Cl.[5] ..... B41J 2/05

[52] U.S. Cl. ..... 346/140 R; 338/333

[58] Field of Search ..... 346/140; 338/308, 309, 338/333

[56] References Cited

U.S. PATENT DOCUMENTS

| | | | |
|---|---|---|---|
| 4,296,421 | 10/1981 | Hara | 346/140 |
| 4,313,124 | 1/1982 | Hara | 346/140 |
| 4,336,548 | 6/1982 | Matsumoto | 346/140 |
| 4,490,728 | 12/1984 | Vaught | 346/140 X |
| 4,490,731 | 12/1984 | Vaught | 346/140 |
| 4,535,343 | 8/1985 | Wright | 346/140 |
| 4,590,482 | 5/1986 | Hay | 346/140 X |
| 4,631,555 | 12/1986 | Ikeda | 346/140 |
| 4,716,423 | 12/1987 | Chan | 346/140 |

*Primary Examiner*—Joseph W. Hartary

[57] ABSTRACT

A thermal ink jet head incorporates bubble-generating resistors, each with a relatively thick layer of unpassivated resistive material, such as TaAl. The thermal ink jet head includes an ink source, ink channels, respective orifices, and circuitry for providing the electrical energy which the resistors convert to heat to form bubbles which expel ink through respective orifices. A range between 3,000 Å and 5,000 Å is preferred for the resistive material to minimize failure rate while avoiding thermal, electrical and manufacturing limitations of passivated resistors.

7 Claims, 2 Drawing Sheets

INK JET HEAD INCORPORATING A THICK UNPASSIVATED TAAL RESISTOR

This application is a continuation of application Ser. No. 07/099,428 filed Sept. 21, 1987, now abandoned.

BACKGROUND OF THE INVENTION

The present invention relates to thermal ink jet printers, and more particularly, to a bubble-generating heating element for the print head of such a printer. It is a major object of the present invention to provide a relatively simple heating element with improved life properties.

Thermal ink jet printers, sometimes referred to as bubble jet printers, are very effective because they produce high velocity droplets and permit very close nozzle spacing for printing relatively high numbers of spots or pixels per inch on paper or other recording medium. The greater the number of pixels per inch, the better the printing resolution, thus yielding higher print quality.

Ink jet printers are usually divided into two basic types, continuous stream and drop-on-demand ink jets. Continuous stream ink jet printers expel ink whether or not ink is desired on the target portion of the recording medium. Accordingly, they typically require an electrode assembly to guide the ink stream and a gutter system to collect and recirculate the portion of ink deflected from the recording medium by the electrode assembly at points where the recording medium is to be left blank.

In contrast, "drop-on-demand" printers propel ink only when ink is required at the target portion of the recording medium. Such printers do not require an ink-recovering gutter or deflecting electrodes. Thus, drop-on-demand printers can be much simpler than the continuous stream type.

Thermal ink jet printers form one class of drop-on-demand printers, the other major class using a piezoelectric transducer to produce pressure pulses selectively to expel ink droplets. Thermal ink jet printers use thermal energy, usually supplied by the momentary heating of a resistor to produce a vapor bubble to propel the ink.

Thermal ink jet printers typically have a print head mounted on a carriage which traverses back and forth across the width of a step-wise movable recording medium. The print head generally comprises a vertical array of nozzles which confronts the recording medium. Ink-filled channels connect to an ink reservoir so that as ink in the vicinity of the nozzles is depleted, it is replaced from the reservoir. Bubble-generating resistive heating elements in the channels near the nozzles are individually addressable by current pulses representative of digitized information or video signals so that each droplet expelled and propelled to the recording medium prints a picture element or pixel.

The current pulses are applied to the heating elements to vaporize momentarily the ink in contact therewith and form a bubble for each current pulse. Ink droplets are expelled from each nozzle by the growth of the bubbles which causes a quantity of ink to bulge from the nozzle and break off into a droplet at the beginning of bubble collapse. As the bubble begins to collapse, part of the ink still in the channel between the nozzle and the bubble starts to move towards the collapsing bubble, causing a necking down of the ink near the nozzle and resulting in the separation of the bulging ink as a droplet.

The heating element is conventionally a resistor covered by one or more passivation layers. The heating element can be fabricated on a silicon substrate having a silicon dioxide layer, which serves as a thermal barrier. The resistor can be deposited on the substrate using standard thin-film processing techniques. The resistor can be a layer of an alloy of tantalum and aluminum (TaAl) and be up to several hundred microns (μm) square.

Heating element thicknesses have been on the order of a few thousand angstroms (Å), most of which is due to passivation layers and metallic coatings. The resistor material itself has been on the order of 1000 Å or less. A trend toward lesser thicknesses, as low as 200 Å is due, in part, to increased resistances and thereby to lower current driver requirements.

The relatively quiet operation perceived by the user of a thermal ink jet printer belies a violent environment on the scale of the bubble-generating resistor. The bubble-generating resistor is typically heated by current pulses. On the scale of the resistor, the shock of the bubble collapsing is a serious source of mechanical fatigue. The problem with fatigue is aggravated in printers provide for burst mode operation in which droplets can be propelled at around 50 kHz.

In addition to the mechanical shock produced by the collapsing bubbles, the resistor is subject to thermal fatigue when it is switched on and off at high frequencies. Thermal fatigue is suspected to aggravate a crack nucleation process, eroding the structural integrity of the resistor. Extended burst-mode operation can also cause heat accumulation, compounding the problem with thermal fatigue. Finally, the turbulent ink and vapor can be quite corrosive, subjecting the resistor to corrosion and erosion. Yet, given present day commercial requirements, a resistor is expected to deliver 40 to 200 million droplets before failure.

While understanding of the individual and interactive effects of the electrical, mechanical, thermal and chemical environment on the bubble-generating resistor is far from complete, the conventional wisdom is that the bare resistor material, including any layer formed thereon by exposure to air, succumbs to fatigue too easily to meet rising commercial expectations for reliability. Accordingly, the resistor material is protected by one or more passivation layers. For example, a TaAl resistor can be coated with a layer of silicon nitride, silicon carbide, or, more commonly, both to minimize the problems due to pinholes. In addition, an overcoat of tantalum or other metal is applied over the passivation layers as an additional impact buffer and as a means for evacuating leakage current. The additional layers reduce the intensity of the impact stress wave induced by the collapsing bubble on the resistor, which is thus protected from cavitation damage.

The improved corrosion and fatigue performance afforded by the additional layers is important enough so that they are applied despite a number of disadvantages. The most apparent disadvantage is the additional manufacturing complexity involved. Typically, seven film layers are required, as opposed to two for the uncoated resistor structure: correspondingly, five, as opposed to two, masking steps are required. The increased manufacturing complexity also corresponds to increased costs and decreased yields on a per wafer basis.

The passivation layers also impede the dissipation of heat. On the one hand this aggravates heat accumulation. Especially during multi-drop half-tone printing in which the burst mode is used repeatedly, accumulated heat can affect ink viscosity significantly. Ink viscosity is a critical variable in determining droplet size and velocity. Without additional complexity involved in implementing viscosity compensation schemes, the variable viscosity decreases printing precision, lowering the overall quality of the output. Furthermore, substantial heat accumulation will increase stress levels in the various layers, which can increase the failure rate of the bubble-generating resistor.

Another disadvantage of passivated resistors is that the turn-on voltage varies sensitively with passivation thickness. This makes it more difficult to determine the proper driving voltage for a given resistor. Driving the resistor with too low a voltage can result in insufficient bubble formation, while excessive voltage rapidly diminishes resistor life due to excessive heating.

An object of the present invention is to provide the best of two resistors: the fatigue resistance of a passivated resistor along with the simplicity, economy, and improved electrical and thermal characteristics of an unpassivated resistor.

SUMMARY OF THE INVENTION

The foregoing and other objects are achieved in a print head using heating element with a relatively thick unpassivated tantalum-aluminum (TaAl) resistor structure. The ink jet head includes an ink source an ink channel and an orifice through which ink droplets are directed toward a recording medium. An electrical circuit provides the current used by the heating element in generating heat which causes ink to be ejected from the channel and through the orifice.

The thickness of the resistor is at least about 1000 Å to improve upon the life performance of heating elements with unpassivated resistors. A thickness of at least 2000 Å achieves life performance comparable to existing passivated resistors, while avoiding the complexity, thermal and electrical disadvantages of such devices. Thicknesses in the range of 3000–5000 Å are preferred and provide superior life characteristics.

The additional thickness of the resistor obviates the need for the passivation layers. Thus, the resistor can be disposed to contact fluid, e.g., ink or the vapor in a thermal bubble, rather than be separated from the fluid by one or more passivation and buffer layers. The resistor layer can be homogeneous in that a single material, generally a metal alloy such as TaAl, can be used to form the resistor. The natural formation of a chemically distinct layer, e.g., an oxide of the metal alloy, does not preclude the layer being considered "homogeneous", as the term is defined herein. However, the qualification "homogeneous" is to be taken to exclude the use of the term "layer" with two separately deposited and materially distinct sublayers.

Heretofore, it was believed that the chemical and physical properties of passivation layers were prime ingredients in the improved fatigue characteristics of incorporating bubble-generating resistors. The unexpected conclusion, in view of tests performed in connection with the present invention, is that it is largely the additional thickness contributed by the passivation layers that improves performance. The serendipitous result of this discovery is that the advantages of the passivation layers can be attained by simply using a thicker resistor, thus avoiding the complexity and thermal and electrical performance limitations imposed by the passivation layers. These and other advantages are provided by the present invention as detailed in the description below with reference to the following drawings.

DESCRIPTION OF THE PREFERRED EMBODIMENT

Figure 1:
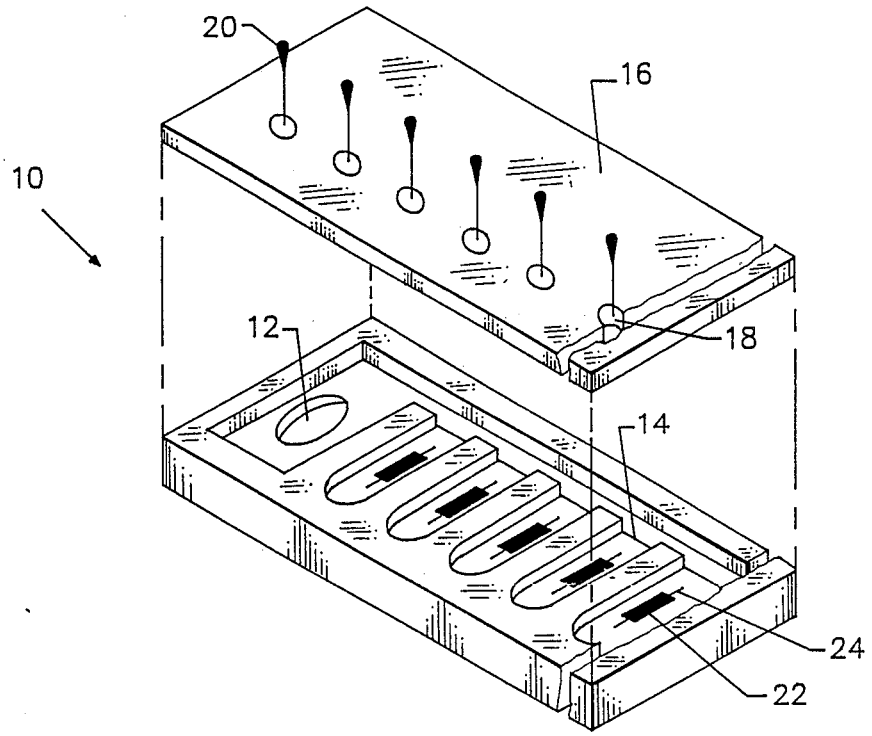
FIG. 1 is a schematic perspective assembly view of a thermal ink jet head in accordance with the present invention.

A print head 10 for a thermal ink jet printer includes a source 12 for supplying ink, channels 14 for conveying ink, and an orifice plate 16 with orifices 18 through which droplets 20 are expelled from the channels 14, as shown in FIG. 1, and propelled toward a recording medium, as is known in the art. Heating element resistors 22 are positioned so that ink within a channel 14 can be expelled through a respective orifice 18 when the respective resistor 22 generates heat. The resistors 22 are arranged in series with respective pairs of conductors 24 which provide the current, the electrical energy of which is converted to thermal energy by the resistors 22 to heat the ink.

Figure 2:
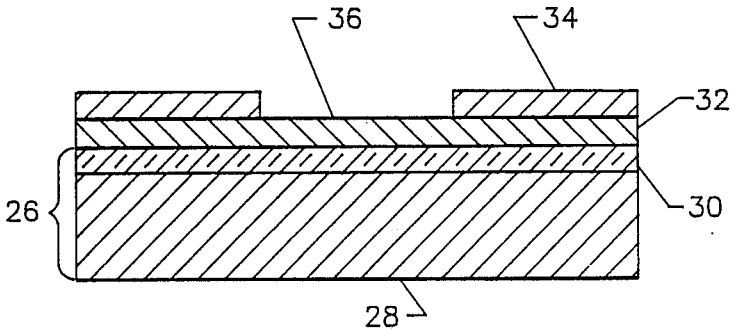
FIG. 2 is a schematic fragmentary cross-sectional view of a heating element of the thermal ink jet head of FIG. 1.

One of the several similar resistors 22, shown in FIG. 2, is fabricated on a semiconductor structure 26 including a silicon substrate 28, and an about 15,000 Å$SiO_2$ thermal barrier layer 30. Resistive material 32 is deposited over the thermal barrier 30, and a conductive layer 34 is deposited over the resistive material 32. The preferred resistive material is TaAl and the conductive layer 34 can be of gold. The conductive layer can be about 5,000 Å thick. The resistor layer can be more than 1000 Å thick to improve on the performance of thinner unpassivated resistors. This figure can be at least doubled to achieve performance comparable to passivated resistor structures. In the illustrated embodiment, the thickness of the resistor layer is between 3,000 Å and 4,000 Å to provide superior life characteristics.

Using masking steps well-known in the semiconductor processing art, the desired conductor "finger" pattern is etched out of the conductive layer 34. A second masking step yields the desired resistive material pattern. After this second masking step, the resistive material 32 extends generally beneath each pair of conductor 24, and bridges the intermediate gap, defined in the first masking step, so as to define a contact surface 36.

The contact surface 36 of the resistive material 32 is disposed to contact fluid, e.g., ink or vapor in a heat-induced bubble, within the respective channel 14. In other words, the TaAl, the contact surface 36 of which can be oxidized by the environment, directly contacts the ink and bubble vapor.

No passivation layer impedes the delivery of heat to the contact surface 36 or the dissipation of heat away from the contact surface 36. This allows for more efficient drop formation, on the one hand, and avoidance of heat accumulation on the other. In the latter case, ink viscosity, and thus printer performance, is stable. The bare resistive material 32 also has a lower and more predictable turn-on voltage, for more precise control of heat delivered to the ink.

Current directed along a conductor 24 must traverse the resistive material at the gap. The heat dissipated by the resistor 22 generates a bubble, as described above, and expels ink through the respective orifice 18.

Figure 3:
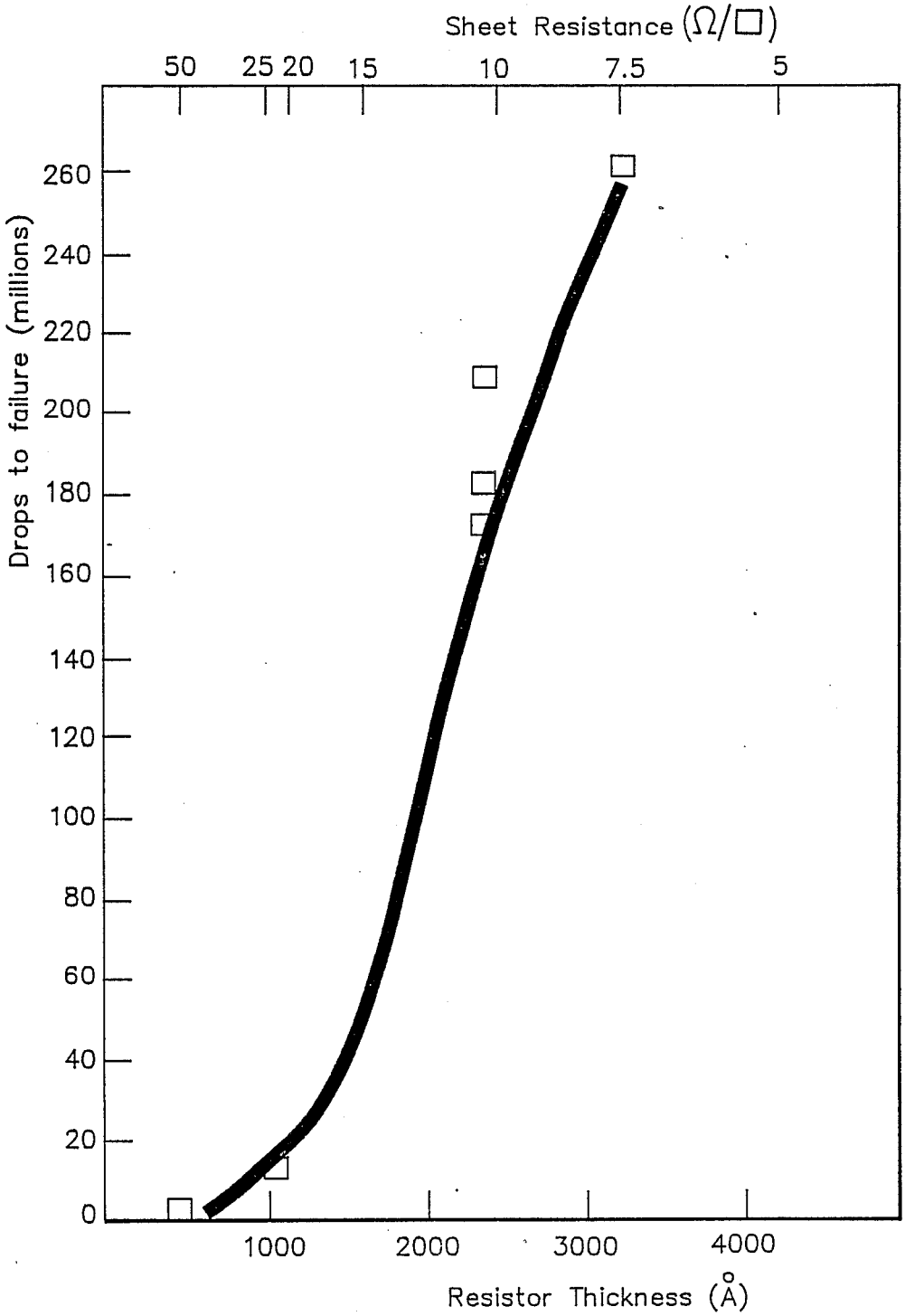
FIG. 3 is a graph illustrating the thickness versus stress life for an unpassivated resistor structure in accordance with the present invention.

The relationship between resistor thickness and first failures of unpassivated TaAl resistors is illustrated in the graph of FIG. 3. The indicated range from 40,000,000 to 110,000,000 droplets is typical of ink jet heads with passivated resistors. An average passivated resistor performance is matched by an unpassivated resistor at around 2000 Å. The graph shows that the resistor of FIG. 2 having a first failure at 260,000,000 droplets.

As is readily apparent to those skilled in the art, the present invention provides for many alternatives to the embodiment described above. A wide range of resistor thicknesses over 1000 Å are provided for. Different resistive materials can be employed. The substrate upon which the resistive material is deposited can be a bare dielectric substrate, such as glass, or can be conductive with different or additional layers between the substrate and the resistive material. Many different configurations for the ink jet head, ink source, ink channels, orifices, and circuitry are provided for by the present invention, the scope of which is limited only by the following claims.

What is claimed is:

1. A print head for a thermal ink jet printer comprising:

ink source means for supplying ink;

orifice means for directing ink expelled therethrough toward a recording medium;

channel means for conveying ink from said ink source to said orifice;

circuit means for supplying a current in response to a control signal; and a resistor structure coupled to said circuit means so that when said circuit means supplies a current said resistor structure converts electrical energy into heat, said resistor structure being arranged with respect to said channel means and said orifice means so that ink within said channel means can be expelled through said orifice in response to the generation of heat by said resistor structure, said resistor structure including a base structure having a substrate and a homogeneous TaAl resistive layer disposed to contact fluid within said channel means, said resistive layer being at least about 2000 Å thick.

2. The print head of claim 1 wherein said resistive layer is at least 3000 Å thick.

3. The print head of claim 1 wherein the thickness of said resistive layer is between 3000 Å and 5000 Å.

4. The print head of claim 1 wherein said base structure includes a conductive substrate and a thermal barrier layer deposited on said substrate, said resistive layer being deposited on said thermal barrier layer.

5. A print head for directing ink toward a recording medium in response to control signals, said print head comprising:

ink source means for supplying ink;

orifice means for directing ink expelled therethrough toward a recording medium;

channel means for conveying ink from said source means to said orifice means;

circuit means for supplying a current in response to a control signal; and a resistor structure coupled to said circuit means so that when said circuit means supplies a current said resistor structure converts electrical energy into heat, said resistor structure being arranged with respect said channel means and said orifice means so that ink within said channel means can be expelled through said orifice means in response to the generation of heat by said resistor structure, said resistor structure including a silicon substrate, a silicon dioxide thermal barrier layer, and a TaAl resistive layer disposed to contact said ink within said channel means, said TaAl resistive layer being at least about 3000 Å thick.

6. The print head of claim 5 wherein the thickness of said resistive layer is at most about 5000 Å.

7. In a print head for a thermal ink jet printer comprising:

ink source means for supplying ink capable of corroding TaAl;

orifice means for directing ink expelled therethrough toward a recording medium;

channel means for conveying ink from said ink source to said orifice;

circuit means for supplying a current in response to a control signal; and a resistor structure coupled to said circuit means so that when said circuit means supplies a current said resistor structure converts electrical energy into heat, said resistor structure being arranged with respect to said channel means and said orifice means so that ink within said channel means can be expelled through said orifice in response to the generation of heat by said resistor structure, said resistor structure including a base structure having a substrate and a resistive TaAl layer;

the improvement wherein:

said TaAl layer is disposed to contact ink within said channel means said is between about 3000 Å and 5000 Å thick;

whereby the operating life of said resistor structure, and thus of said print head, is enhanced.

* * * * *